United States Patent [19]

Arai et al.

[11] Patent Number: 4,823,733

[45] Date of Patent: Apr. 25, 1989

[54] CONVEYER HANGER FOR USE IN ELECTRO-STATIC PAINTING

[75] Inventors: Seizou Arai, Yokohama; Kikuo Fukumoto, Kanagawa; Seizo Sunaga, Hiratsuka; Kouji Izumida, Ayase, all of Japan

[73] Assignee: Topy Kogyo Kabushiki Kaisha, Tokyo, Japan

[21] Appl. No.: 62,578

[22] Filed: Jun. 6, 1987

[51] Int. Cl.[4] ..... B05B 5/02

[52] U.S. Cl. ..... 118/630; 118/631; 118/635; 118/500

[58] Field of Search ..... 118/500, 630, 631, 632, 118/633, 635; 204/297 W

[56] References Cited

U.S. PATENT DOCUMENTS

| | | | |
|---|---|---|---|
| 2,746,732 | 5/1956 | Guillette | 118/500 X |
| 2,841,549 | 7/1958 | Hogaboom, Jr. | 204/297 W |
| 2,885,063 | 5/1959 | Austin et al. . | |
| 2,918,164 | 12/1959 | Austin et al. . | |
| 2,960,206 | 11/1960 | Daugherty . | |
| 3,202,261 | 8/1965 | Pianowski . | |
| 3,888,361 | 6/1975 | Becket et al. . | |
| 4,699,264 | 10/1987 | Tsuruoka et al. . | |
| 4,739,874 | 4/1988 | Akutagawa et al. | 198/468.2 |

FOREIGN PATENT DOCUMENTS

| | | |
|---|---|---|
| 0025082 | 2/1979 | Japan . |
| 0688395 | 9/1979 | U.S.S.R. . |
| 1079560 | 3/1984 | U.S.S.R. . |
| 1118592 | 10/1984 | U.S.S.R. . |

OTHER PUBLICATIONS

Becke Insulated Racks, Bekke Mfg. Co., 8 pages, Mar. 14, 1939.

*Primary Examiner*—Shrive Beck

*Attorney, Agent, or Firm*—Cushman, Darby & Cushman

[57] ABSTRACT

A conveyor hanger used for carrying an annular work which is to be painted through an electro-static painting station. The conveyor hanger includes an arm which is inclined from the horizontal and which has a sharp edge at a top of its cross-section. A liquid paint of little electro-conductivity attached to the arm will thus flow down along the arm and will not collect on the arm. Due to the sharp edged cross-section, even if the paint remains on the arm, abrasion between the work and the sharp edge of the arm will remove the remaining paint. Thus, good electro-conductivity between the work and the arm is obtained.

19 Claims, 5 Drawing Sheets

CONVEYER HANGER FOR USE IN ELECTRO-STATIC PAINTING

BACKGROUND OF THE INVENTION

1. Field of the Invention

The present invention relates to a conveyer hanger for carrying an annular work such as a disk wheel which is conveyed through an electro-static painting station.

2. Description of the Prior Art

In a prior art disk wheel production line, a painting booth for electro-static painting is disposed at a final stage of the production line for the disk wheel of a vehicle. The path of a hanger conveyer for carrying and conveying a work (in this case, a disk wheel) is disposed so as to pass through the painting booth. The hanger conveyer has a plurality of conveyer hangers which are conveyed in a work conveying direction, and each conveyer hanger has vertically extending support rod with a plurality of arms which are fixed at one end thereof to the support rod. The arms extend horizontally and comprise a rod having a circular cross-section. A work to be painted is loaded onto the arms manually on a front side of the painting booth, and the work which has been painted is then manually unloaded from the arms on a rear side of the painting booth. When the work is within the painting booth, on the arm, an electric current flows through the work and the arm such that paint being applied to the work attaches to the surface of the work and is thereby electro-statically painted.

When the arm of the hanger extends horizontally, however, the paint used in electro-static painting collects on the arm and deteriorates the electro-conductivity of the arm so as to cause deficiencies in the painting of the work, for the collected paint has little electro-conductivity. Also since the vertically extending support rod of the conventional hanger is free, balancing of the loaded works during loading/unloading is easily deteriorated, for the support rod inclines from the vertical such that the work easily slips down from the horizontally extending arm.

OBJECTS AND SUMMARY OF THE INVENTION

An object of the present invention is to provide a conveyer hanger in which collecting of paint on a work-supporting arm is suppressed.

Another object of the present invention is to provide a conveyer hanger in which the paint collecting on the contact portion between the arm and the work is removed from the contact portion by the work when the work is loaded on the arm.

Yet another object of the present invention is to provide a conveyer hanger which is capable of preventing the work from slipping down from the arm of the conveyer hanger.

Still another object of the present invention is to provide a conveyer hanger which is prevented from inclining during loading/unloading of a work.

The above objects can be achieved, according to the present invention, by utilizing a conveyer hanger for carrying an annular work which is conveyed through an electro-static painting station, comprising:

a vertically extending support rod; and at least one arm, fixed at its one end to said support rod, for carrying said work, said arm extending obliquely upward in a direction away from said support rod and having a cross-section that has a sharp edge at a top side of the cross-section where the work is supported by the arm.

Preferably, the arm of the conveyer hanger is inclined with respect to the horizontal by an angle not less than 25°.

In the conveyer hanger thus constructed, since the arm is inclined from the horizontal, the liquid paint attached to the arm flows along the arm toward the lower portion of the arm and does not continue to collect on the arm. The inclination angle not being less than 25° has been determined by tests, and when the inclination angle was less than 25°, smooth flowing of the paint down the arm could not be obtained. However, when the inclination angle is too large, it becomes difficult to load/unload the work on/from the arm.

Also, since the contact portion of the arm with the work is formed as a sharp edge, the paint attached to the contact portion of the arm is removed from the arm through abrasion by the work as the work slides with respect to the arm during loading. Thus, the arm and the work directly contact each other without the connection being made through the attached paint, and as a result, good electro-conductivity between the arm and the work is obtained. As a result, good quality electro-static painting is obtained.

BRIEF DESCRIPTION OF THE DRAWINGS

These and other objects of the present invention will become apparent and more readily appreciated from the following detailed description of the presently preferred exemplary embodiment of the invention taken in conjunction with the accompanying drawing, of which.

DETAILED DESCRIPTION OF THE PREFERRED EMBODIMENT

Figure 1:
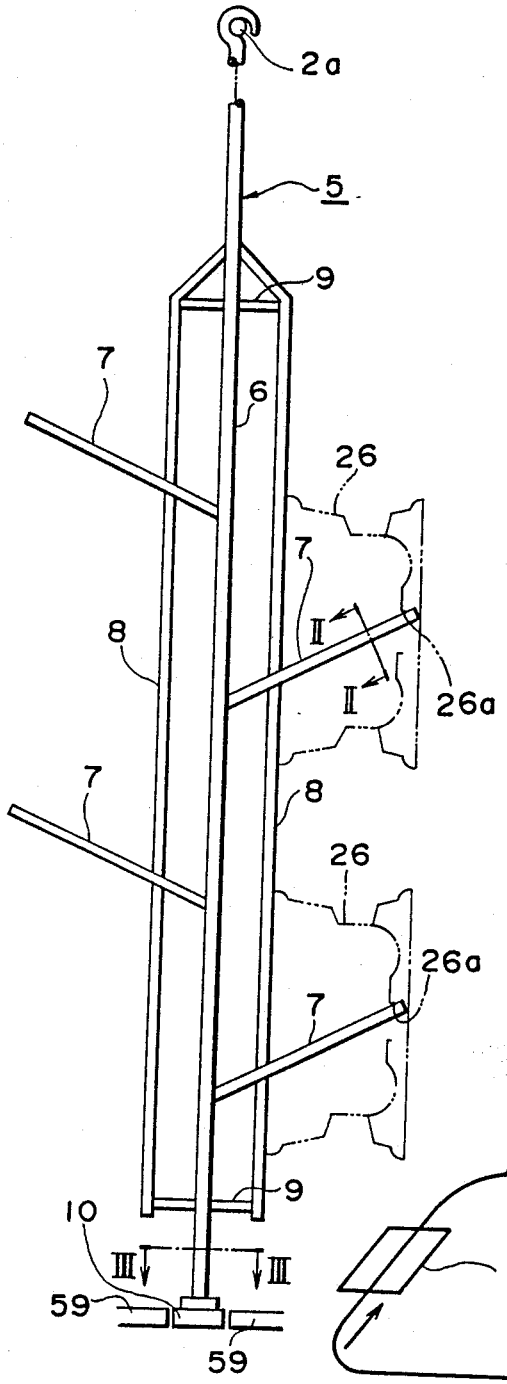
FIG. 1 is an elevational view of the conveyer hanger according to the present invention.
Figure 2:
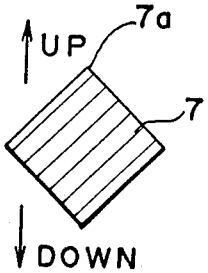
FIG. 2 is a cross-sectional view of an arm of the conveyer hanger taken along line II—II of FIG. 1.
Figure 3:
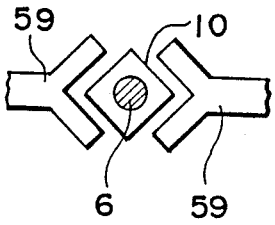
FIG. 3 is a cross sectional view of a lower portion of the conveyer hanger taken along line III—III of FIG. 1.
Figure 9:
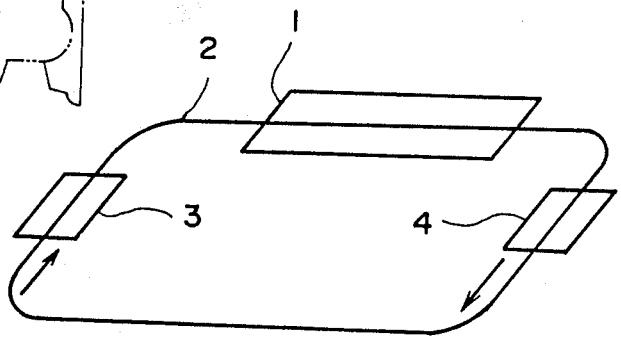
FIG. 9 is a schematic representation of a portion of a production line using the conveyer hanger of FIG. 1 as part of a painting apparatus.

FIGS. 1–3 illustrate a conveyer hanger according to one embodiment of the present invention. FIGS. 4–8 illustrate a loading/unloading apparatus which can be used for loading/unloading a work on/from the conveyer hanger in which, by way of example, a disk wheel for a vehicle is used as a work. FIG. 9 illustrates the disposition of such a conveyer hanger and such a loading/unloading apparatus when they are used together with a painting booth for painting a disk wheel of a vehicle.

In FIG. 9, reference numeral 1 designates a painting station which comprises a painting booth for electrostatic painting, and reference numeral 2 designates a hanger conveyer for conveying a work such as a disk wheel as shown in FIG. 1. Hanger conveyer 2 comprises an endless hanger conveyer which passes through painting booth 1, and on a front side and a rear side of the painting booth 1 along a work conveying direction are respectively disposed loading/unloading apparatuses 3 and 4 for loading and unloading the work on/-from hanger conveyer 2, respectively. Loading/unloading apparatus 3 disposed on the front side of painting booth 1 is used for loading the work on hanger conveyer 2, and loading/unloading apparatus 4 disposed on the rear side of painting booth 1 is used for unloading the work from hanger conveyer 2. Since loading/unloading apparatuses 3 and 4 have substantially the same structure as each other, explanation will be given only for the loading/unloading apparatus 4 hereinafter.

FIG. 1 illustrates a conveyer hanger 5 of hanger conveyer 2 for carrying and conveying an annular work such as disk wheel 26 shown in FIG. 1. Conveyer hanger 5 comprises a vertically extending support rod 6 and arms 7, fixed at one end to support rod 6, for carrying work 26. Each arm 7 extends in a plane at a right angle with respect to the work conveying direction and extends obliquely upward in a direction away from support rod 6. Arm 7 is inclined with respect to the horizontal by an angle not less than 25°, and as shown in FIG. 2, arm 7 has a cross-section containing a sharp edge 7*a* at a top of the cross-section. In the embodiment of FIG. 2, for example, arm 7 has a square cross-section, one diagonal of which is directed in a vertical direction. The top corner of the square cross-section thus comprises the sharp edge 7*a*.

A plurality of arms 7 are provided on right and left sides of support rod 6 as viewed in the work conveying direction. Arms 7 provided on the right side of support rod 6 and arms 7 provided on the left side of support rod 6 are staggered with respect to each other in the vertical direction as shown in FIG. 1.

Conveyer hanger 5 further comprises connecting rods 8 which are provided on the right and left sides of support rod 6 as viewed in the work conveying direction and which extend in a vertical direction so as to connect arms 7 to each other. Connecting rods 8 also function as a stopper for work 26 when work 26 is loaded on arms 7. Uppermost and lowermost portions of connecting rods 8 are connected via upper and lower transverse rods 9 to support rod 6, respectively. Conveyer hanger 5 comprises a material having electroconductivity and further comprises an engaging member 10 fixed to a lowermost portion of support rod 6. As shown in FIG. 3, engaging member 10 has a square cross-section so that it may be firmly clamped by a pair of hanger clamping means 59 as will be described hereinafter.

A plurality of such conveyer hangers 5 are provided in hanger conveyer 2. The plurality of conveyer hangers 5 are spaced from each other in the work conveying direction and are driven by a chain 2*a* of hanger conveyer 2 in the work conveying direction.

FIGS. 4–8 illustrate in detail the loading/unloading apparatus 4. Reference numeral 11 designates a truck which comprises a body 12, a driving mechanism 13 mounted on body 12 for generating a driving force, and a body-carrying portion 14. Truck 11 is driven by driving mechanism 13 so as to move at the same speed as conveyer hanger 5. Truck 11 also moves along a rail 27 in the same direction as conveyer hanger 5.

Driving mechanism 13 comprises a variable-speed motor 15, a speed reducer 16, and a clutch 17 which are coupled to each other by couplings 18 and 19. A sprocket 20 is connected to an output shaft of clutch 17 and engages with roller chain 21 which is wound around sprocket 20 so as to transmit the driving force.

Body-carrying portion 14 comprises wheels 22 and a wheel shaft 23. Wheels 22 are connected to end portions of wheel shaft 23, and wheel shaft 23 is supported via a bearing 24 by body 12. A sprocket 25 is connected to wheel shaft 23, and roller chain 21 is wound around sprocket 25 so that the driving force from driving mechanism 13 is transmitted to wheels 22.

Control of the moving speed of truck 11 is performed by controlling the speed of variable motor 15 such that truck 11 is driven at the same speed as the conveying speed of the work 26 (the speed of conveyer hanger 5) which is carried by arm 7 of the moving conveyer hanger 5. Rail 27 is a fixed rail on which wheels 22 of truck 11 rotate as they are guided by rail 27. Reference numeral 28 designates the fixed framework for rail 27.

Figure 4:
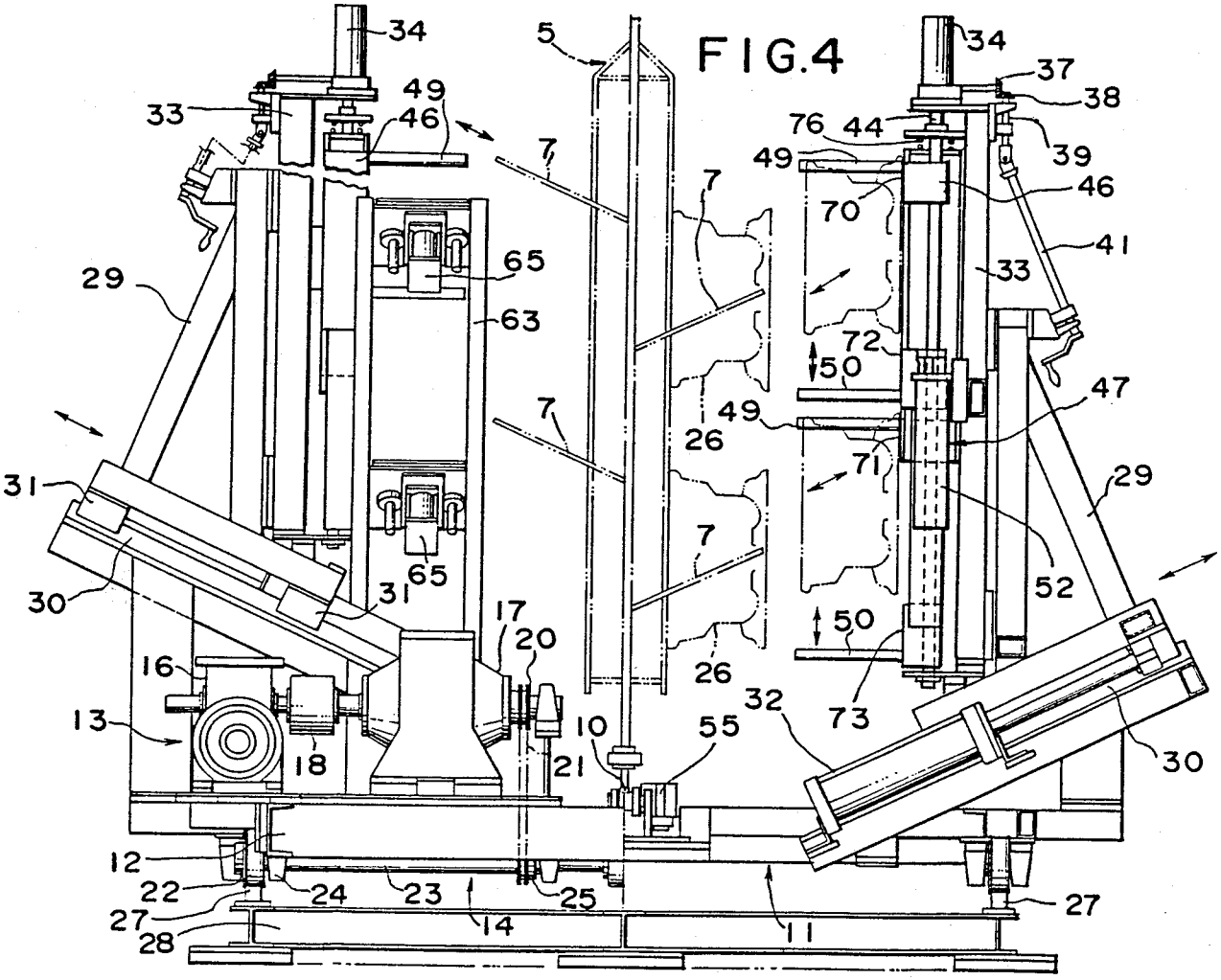
FIG. 4 is an elevational view of a loading/unloading apparatus which is preferably to be used for loading/unloading a work on/from the conveyer hanger of FIG. 1.

A rail 30 for guiding and sliding a framework 29 is fixed to truck 11 in a plane which is at a right angle with respect to the work conveying direction and moves together with truck 11 in the work conveying direction. Two rails 30 are provided on truck 11, and one of the two rails 30 is disposed on the right side of the path of conveyer hanger 5 while the other of the two rails 30 is disposed on the left side of the path of conveyer hanger 5 as shown in FIG. 4. One of the two rails 30 is disposed lower than the other of the two rails 30 by the vertical distance between staggered right and left arms 7. Rail 30 obliquely extends in the direction parallel to the direction in which arm 7 of conveyer hanger 5 extends. In other words, the inclination of rail 30 is the same as that of arm 7.

Framework 29 is slidable with respect to rail 30 by means of a sliding bearing 31 which is fixed to a lower portion of framework 29. Driving means for driving framework 29 may comprise, for example, an air cylinder 32 which is fixed to truck 11 or rail 30 at its cylinder portion. An end portion of a rod of air cylinder 32 is also connected to the framework 29; therefore, framework 29 is capable of moving toward and receding away from conveyer hanger 5 through operation of air cylinder 32 with respect to truck 11. Framework 29 also includes a slide shaft holder 33 which extends in the vertical direction and a vertically extending slide shaft 51 which is supported by slide shaft holder 33 at upper and lower end portions of slide shaft 51. Slide shaft holder 33 and slide shaft 51 thus compose one portion of framework 29.

Figure 6:
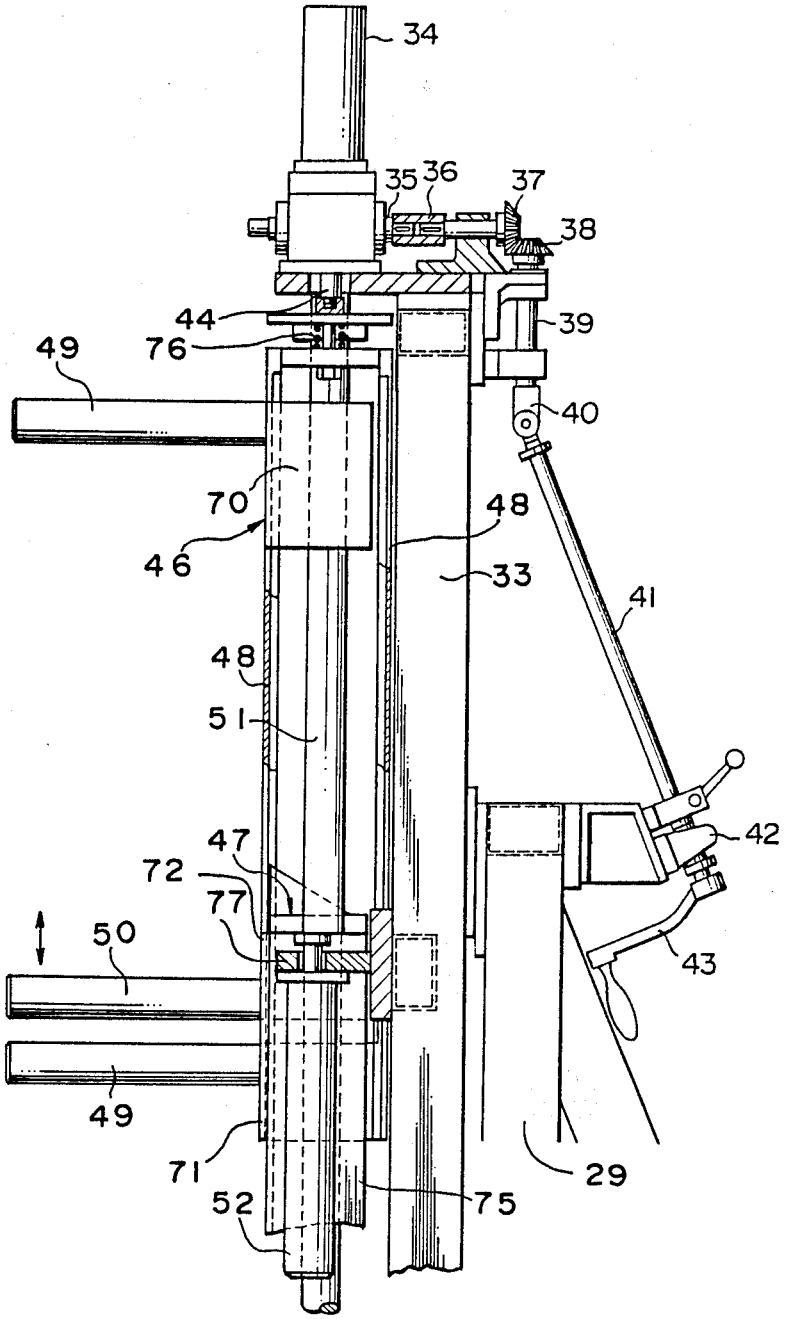
FIG. 6 is an enlarged view of a lifter and the vicinity thereof in the apparatus of FIG. 4.

FIG. 6 shows in greater detail an embodiment of a lifter comprising, for example, a screw jack 34 which is fixed to a top portion of framework 29. An input shaft 35 of screw jack 34 is connected via a coupling 36 to a bevel gear 37 which is engaged with another bevel gear 38. A shaft 39 which is connected to bevel gear 38 is connected via a universal joint 40 to another shaft 41. Shaft 41 is supported via a bearing 42 by slide holder 33, and a handle 43 is coupled to the end portion of shaft 41.

An upper work-holding means 46 which is slidable along slide shaft 51 in the vertical direction is hanged by an output shaft 44 of screw jack 34 such that a position of upper work-holding means 46 can be adjusted in the vertical direction by rotating handle 43. As shown in FIG. 6, upper work-holding means 46 comprises upper and lower pin holders 70 and 71, a tie bar 48 for connecting pin holders 70 and 71, and upper clamp arm pins 49 which are fixed to each of pin holders 70 and 71. Upper work-holding means 46 is connected via a spring mechanism 76 which composes an upper portion of upper work-holding means 46 to a lower portion of output shaft 44 of screw jack 34. Spring mechanism 76 allows upper and lower pin holders 70 and 71 to move upward relative to output shaft 44 of screw jack 34 in the vertical direction when upper work-holding means 46 receives a large upward force from work 26. There are two connecting tie bars 48 which extend in the vertical direction. There are also two pairs of upper clamp arm pins 49, one pair of upper clamp arm pins 49 being connected to upper pin holder 70 while the other pair of upper clamp arm pins 49 is connected to lower pin holder 71. Each upper clamp arm pin 49 extends horizontally in a plane which is at a right angle with respect to the work conveying direction.

Lower work-holding means 47 is slidable with respect to slide shaft 51 so that lower work-holding means 47 can be moved along slide shaft 51 in the vertical direction. Clamp driving means such as an air cylinder 52 is interposed between a member composing one portion of framework 29 and lower work-holding means 47. A cylinder portion of air cylinder 52 is fixed to the member 77, and a rod portion of air cylinder 52 is connected to lower work-holding means 47. Due to this configuration, an extension/compression stroke of air cylinder 52 drives lower work-holding means 47 with respect to framework 29 and with respect to upper work-holding means 46 in the vertical direction.

Lower work-holding means 47 comprises upper and lower pin holders 72 and 73, a vertically extending tie bar 75 which connects upper and lower pin holders 72 and 73 together, and lower clamp arm pins 50 which are fixed to each of pin holders 72 and 73. There are two pairs of lower clamp arm pins 50 which are fixed to upper and lower pin holders 72 and 73, respectively. Thus, when air cylinder 52 is operated, lower work-holding means 47 moves in a vertical direction relative to upper work-holding means 46, and when lower work-holding means 47 is moved upward, work 26 is clamped and held between upper clamp arm pins 49 and lower clamp arm pins 50.

Figure 5:
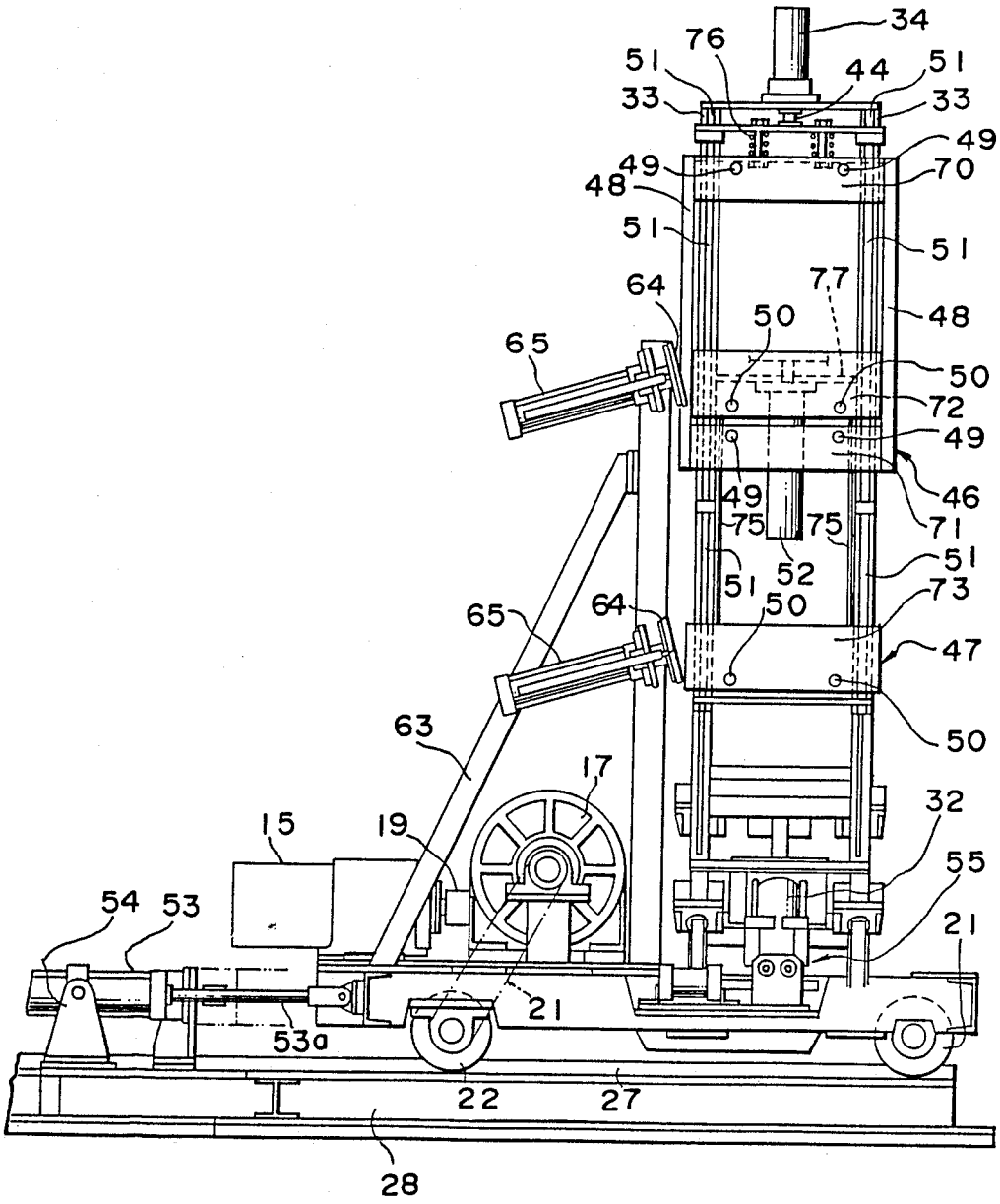
FIG. 5 is a side view of the apparatus of FIG. 4.

As also shown in FIG. 5, in the vicinity of one end of rail 27 on which truck 11 runs, a quick reversing means such as an air cylinder 53 is provided. A cylinder portion of air cylinder 53 is fixed via a bracket 54 to the fixed framework 28, and a rod **53*a* of air cylinder 53 is connected to truck 11. Air cylinder 53 is operated so as to reverse truck 11 to its original waiting position at a speed faster than the speed at which truck 11 is driven by driving mechanism 13 in the work conveying direction after truck 11 has been driven by variable-speed motor 15 to its stroke end. During such reversing of truck 11, clutch 17 of driving mechanism 13** is cut-off.

Figure 7:
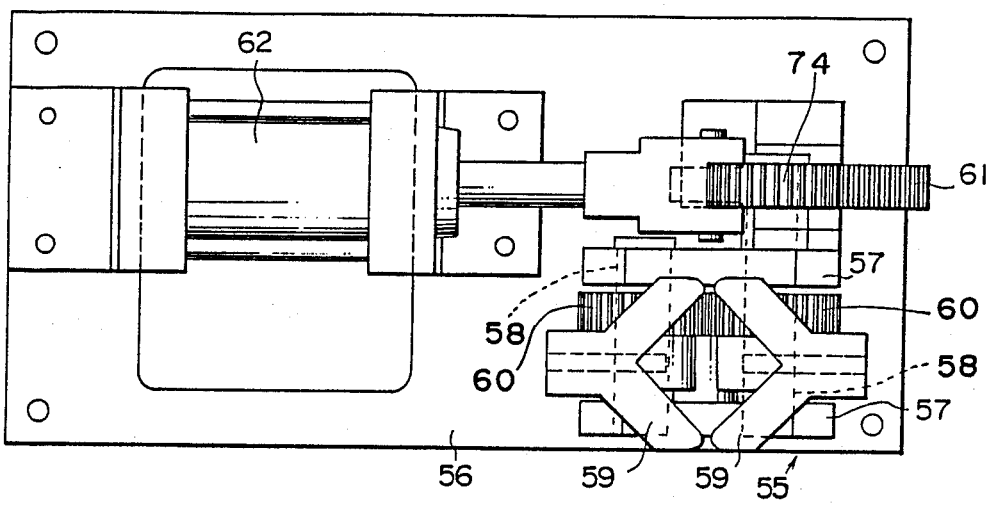
FIG. 7 is a plan view of the hanger clamping means of the apparatus of FIG. 4.
Figure 8:
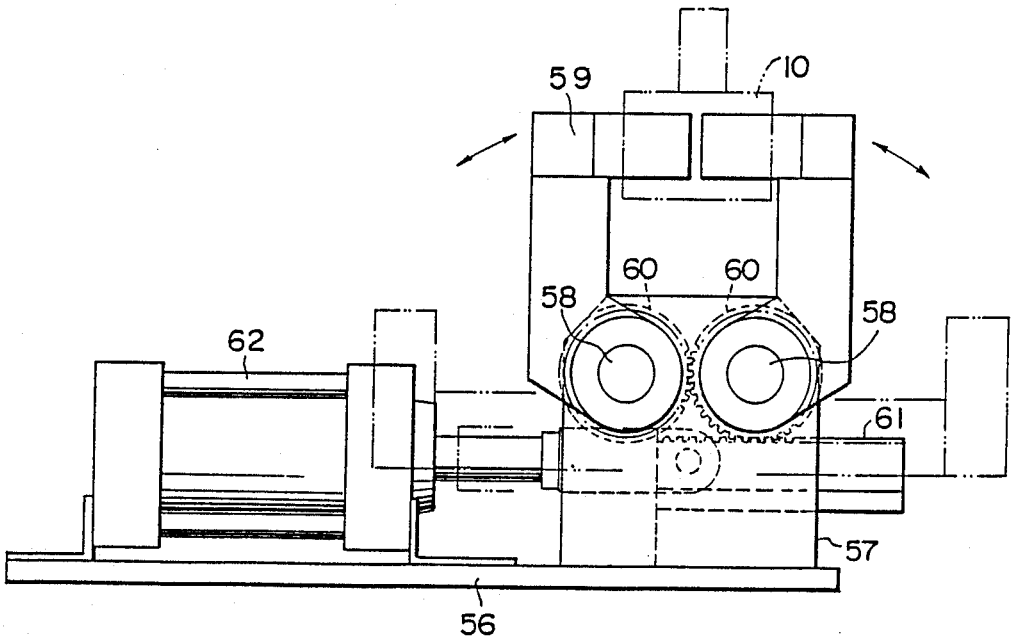
FIG. 8 is an elevational view of the hanger clamping means of FIG. 7.

A hanger clamping means 55 for clamping engaging member 10 which is fixed to the lower portion of support rod 6 of conveyer hanger 5 during the loading/unloading of work 26 is also provided on truck 11. FIGS. 7 and 8 illustrate the structure of hanger clamping means 55. As shown in FIGS. 7 and 8, a pair of support brackets 57 is fixed to a plate 56 which is fixed to truck 11. Two shafts 58 penetrate support brackets 57, and each of a pair of Y-shaped clampers 59 for clamping engaging member 10 are respectively connected to each shaft 58. As shown, clampers 59 are disposed opposite to each other. Also, gears 60 are connected to respective shafts 58 and are mesh-engaged to each other. Another gear 74 is connected to one of shafts 58 and is mesh-engaged with a rack 61 which is connected to a rod of an air cylinder 62. Thus, when air cylinder 62 is operated, shafts 58 rotate around their axes such that clampers 59 are rotated to clamp/unclamp.

Referring back to FIG. 5, bracket 63 is also fixed to truck 11. Two pushers 64 for pushing work 26 in the oblique direction are connected to ends of the rods of air cylinders 65, which are supported by bracket 63. When pushers 64 are operated, works 26 are ejected from lower clamp arm pins 50 in an unloading operation.

Next, operation of the above-described conveyer hanger and loading/unloading apparatus will be explained taking the loading operation as an example.

Empty conveyer hanger 5 (carrying no work 26) is conveyed to loading/unloading apparatus 4. By this time, truck 11 has been reversed to its original waiting position by quick reversing air cylinder 53. Then, when conveyer hanger 5 comes to a predetermined position, variable-speed motor 15 begins its operation, and truck 11 is then driven by variable-speed motor 15 at the same speed as the moving speed of conveyer hanger 5 in the hanger conveying direction. At the same time, engaging member 10, which is fixed to the lower portion of conveyer hanger 5, is clamped by hanger clamping means 55. Conveyer hanger 5 thus moves together with truck 11 so that inclining of conveyer hanger 5 is prevented. By this time, upper work-holding means 46 and lower work-holding means 47 clamp therebetween work 26 which is to be painted.

Following the above-mentioned operation, during movement of truck 11, air cylinder 32 for driving framework 29 begins its operation so that framework 29 holding work 26 slides toward conveyer hanger 5 along rail 30. When framework 29 comes to a predetermined position nearest to conveyer hanger 5, it stops. At this stage, since work 26 clamped between upper and lower clamp arm pins 49 and 50 moves the same direction in which arm 7 extends, interference between work 26 and arms 7 does not occur. Once the framework has stopped, air cylinder 52, which operates as a clamp driving means, begins its operation such that lower work-holding means 47 is moved downward. Thus, work 26 is relieved from the clamp by the upper and lower clamp arm pins 49 and 50 and is put on arm 7 of conveyer hanger 5. Arm 7 thus penetrates a hole of the annular work 26 (a hub hole of the disk wheel) and supports the annular work 26 at an inside surface of the hole.

Work 26 which has been put on arm 7 slips along arm 7 by gravity toward connecting rod 8 where it stops, this slipping occurring because arm 7 is inclined from the horizontal. During sliding, work 26 slide-contacts sharp edge **7*a* of arm 7 and takes off the paint, even if such paint has remained at sharp edge 7*a*. Sharp edge 7*a* thus makes removal of the paint from arm 7 smooth and substantially complete. As a result, direct contact of work 26 with arm 7** is obtained.

When unclamping of work 26 from upper and lower clamp arm pins 49 and 50 has been confirmed, air cylinder 32 again operates to move framework 29 in the direction away from hanger 5 and back to its original position where it stops. At the same time, hanger clamping means 55, which has clamped engaging member 10 fixed to the lower portion of hanger 5, is rotated through operation of air cylinder 62 so that engaging member 10 is unclamped. When relief of engaging member 10 is confirmed, clutch 17 of driving portion 13 of truck 11 is cut-off, and the transmission of a driving force to wheel shaft 22 is cut-off. Thus, wheel shaft 22 may rotate freely. Under this condition, air cylinder 53 for quick reversing is operated so that truck 11 is returned to its original waiting position where the next work 26 is loaded on the loading/unloading apparatus. Truck 11 continues to wait at the waiting position until the next hanger conveyer 5 is conveyed to the position corresponding to the waiting position.

Conveyer hanger 5 on which work 26 has been loaded continues to move in the work conveying direction and enters painting booth 1 where electro-static painting is performed. During electro-static painting, paint is attached to the surface of work 26 and also to the surface of conveyer hanger 5. However, since arm 7 is inclined from the horizontal, the attached paint flows down along arm 7 and does not continue to collect on arm 7. When arm 7 is inclined from the horizontal by an angle not less than 25°, smooth flowing down of the paint along arm 7 is obtained. However, too much inclination makes it difficult to load/unload work 26 on/-from the obliquely extending arm 7; therefore, the inclination is preferably selected to form an angle not more than 45° with the horizontal. In addition, when conveyer hanger 5 passes through painting booth 1, it may incline or sway from the vertical because it is not clamped by clamping member 59. However, in the present invention, since arm 7 extends obliquely, work 26 does not slip down from arm 7.

The unloading operation of loading/unloading apparatus 3 is substantially the same as the above-mentioned loading operation except that in the unloading operation work 26 is unloaded from arm 7 of conveyer hanger 5.

Although only one embodiment of the present invention has been described in detail above, those skilled in the art will readily appreciate that many modifications are possible in the exemplary embodiment without materially departing from the novel teachings and advantages of the present invention. Accordingly, all such modifications are intended to be included within the scope of the present invention as defined in the following claims.

What is claimed is:

1. A conveyer hanger for carrying an annular work which is conveyed through an electro-static painting station, comprising:

a vertically extending support rod;

at least one arm, fixed at its one end to said support rod, for carrying said work, said arm extending obliquely upward in a direction away from said support rod and having a substantially sharp edge running substantially the length of the arm at a top side of a cross-section of the arm where the work is supported by the arm.

2. A conveyer hanger according to claim 1, wherein said arm is inclined with respect to the horizontal by an angle not less than 25°.

3. A conveyer hanger according to claim 1, wherein said arm has a square cross-section, one diagonal of which is directed in a vertical direction.

4. A conveyer hanger according to claim 1, wherein said arm extends in a plane passing through said vertical support rod and perpendicular to a horizontal plane to be at a right angle with respect to the direction in which said work is conveyed through a horizontally positioned electro-static painting station.

5. A conveyer hanger according to claim 1, wherein a plurality of said arms are provided on opposing sides of said support rod.

6. A conveyer hanger according to claim 5, wherein said arms provided on opposing sides of said support rod are staggered with respect to each other in a vertical direction.

7. A conveyer hanger according to claim 5, further comprising connecting rods which are provided on opposing sides of said support rod, said connecting rods extending in a vertical direction so as to connect said arms to each other.

8. A conveyer hanger according to claim 7, wherein uppermost and lowermost portions of said connecting rods are connected via upper and lower transverse rods to said support rod, respectively.

9. A conveyer hanger according to claim 1, wherein said conveyer hanger is comprised of an electro-conductive material.

10. A conveyer hanger according to claim 1, further comprising an engaging member fixed to a lowermost portion of said support rod, said engaging member having a square cross-section.

11. A conveyer hanger system for carrying an annular work through an electro-static painting station comprising:

a loading and unloading apparatus for loading and unloading the work on a conveyer hanger, the loading and unloading apparatus including:

a truck which is driven at the same speed as the speed of said conveyer hanger in the same direction as the direction of movement of said conveyer hanger when the work is loaded and unloaded;

a work-holding means, for clamping and unclamping the work, mounted on said truck so as to be driven in a direction extending obliquely upward in a direction away from said conveyer hanger in a plane at a right angle with respect to the direction of movement of said conveyer hanger;

a vertically extending support rod;

at least one arm, fixed at its one end to said support rod, for carrying said work, said arm extending obliquely upward in the same direction as the direction of movement of said work-holding means in the plane at a right angle with respect to the direction of movement of said conveyer hanger and having a substantially sharp edge running substantially the length of the arm at a top side of a cross-section of the arm where the work is supported by the arm; and an engaging member with a polygonal cross-section, fixed to a lowermost portion of said support rod, said engaging member being clamped by a clamper which is mounted on said truck when the work is loaded and unloaded, so as to relatively fix said lowermost portion of said conveyer hanger to said truck of said loading and unloading machine in each direction of said direction of movement of said conveyer hanger, said direction at a right angle with respect to the direction of movement of said conveyer direction and a rotational direction around an axis of said support rod.

12. A conveyer hanger system according to claim 11, wherein said engaging member has a square cross-section.

13. A conveyer hanger system according to claim 11, wherein said arm is inclined with respect to the horizontal by an angle not less than 25°.

14. A conveyer hanger system according to claim 11, wherein said arm has a square cross-section, one diagonal of which is directed in a vertical direction.

15. A conveyer hanger system according to claim 11, wherein a plurality of said arms are provided on opposing sides of said support rod.

16. A conveyer hanger system according to claim 15, wherein said arms provided on opposing sides of said support rod are staggered with respect to each other in a vertical direction.

17. A conveyer hanger system according to claim 15, further comprising connecting rods which are provided on opposing sides of said support rod, said connecting rods extending in a vertical direction so as to connect said arms to each other.

18. A conveyer hanger system according to claim 17, wherein uppermost and lowermost portions of said connecting rods are connected via upper and lower transverse rods to said support rod, respectively.

19. A conveyer hanger system according to claim 11, wherein said conveyer hanger is comprised of an electro-conductive material.

* * * * *

UNITED STATES PATENT AND TRADEMARK OFFICE

CERTIFICATE OF CORRECTION

PATENT NO. : 4,823,733

DATED : April 25, 1989

INVENTOR(S) : ARAI et al.

It is certified that error appears in the above-identified patent and that said Letters Patent is hereby corrected as shown below:

ON THE FIRST, COVER PAGE:

Reads: "[22] Filed: Jun. 6, 1987"

Should Read: --[22] Filed: Jun. 16, 1987--

Signed and Sealed this

Second Day of January, 1990

*Attest:*

JEFFREY M. SAMUELS

*Attesting Officer*

*Acting Commissioner of Patents and Trademarks*